US006058757A

United States Patent [19]

Laurent et al.

[11] Patent Number: 6,058,757

[45] Date of Patent: May 9, 2000

[54] MACHINING OF SHEET BY COMPRESSION WITHOUT REMOVAL OF MATERIAL

[75] Inventors: Daniel Laurent, Marly; Giancarlo Pegoraro, St.-Legier, both of Switzerland

[73] Assignee: Conception et Developpement Michelin S.A., Givisiez, Switzerland

[21] Appl. No.: 09/190,833

[22] Filed: Nov. 12, 1998

[30] Foreign Application Priority Data

Nov. 13, 1997 [FR] France ..... 97/14344

[51] Int. Cl.[7] ..... B21D 31/00

[52] U.S. Cl. ..... 72/377; 72/184; 72/187

[58] Field of Search ..... 72/184, 187, 285, 72/377, 167, 177, 179

[56] References Cited

U.S. PATENT DOCUMENTS

| | | | |
|---|---|---|---|
| 2,148,469 | 2/1939 | Hudson . | |
| 2,224,337 | 12/1940 | Bostwick . | |
| 2,935,114 | 5/1960 | Anderson . | |
| 3,495,427 | 2/1970 | Balamuth . | |
| 3,514,989 | 6/1970 | Robinson | 72/377 |
| 3,768,296 | 10/1973 | Pollak | 72/377 |
| 4,528,836 | 7/1985 | Durand-Texte | 72/377 |
| 5,086,635 | 2/1992 | Creaser . | |
| 5,156,036 | 10/1992 | Michaels | 72/285 |
| 5,327,767 | 7/1994 | Narishima | 72/184 |
| 5,492,669 | 2/1996 | Laurent et al. . | |

FOREIGN PATENT DOCUMENTS

| | | |
|---|---|---|
| 718044 | 1/1932 | France . |
| 991116 | 10/1951 | France . |
| 1217035 | 4/1960 | France . |
| 52568 | 6/1942 | Netherlands . |
| 1480164 | 7/1977 | United Kingdom . |

*Primary Examiner*—Ed Tolan
*Attorney, Agent, or Firm*—Baker Botts L.L.P.

[57] ABSTRACT

The method and device for machining a sheet and controlling the thickness between the opposite faces of said sheet in a press between sheet engaging surfaces, at least one of which is a bearing surface of narrow width extending across the width of the sheet, in which the space between them is controlled to modify the thickness of the sheet in a series of successive steps which include moving the sheet relative to the sheet engaging surfaces, stopping the movement of the sheet and moving the sheet engaging surfaces against the sheet to compress the sheet to a predetermined thickness and controlling the stepped movement of the sheet and the movement of the sheet engaging surfaces in alternate and successive sequences.

12 Claims, 5 Drawing Sheets

MACHINING OF SHEET BY COMPRESSION WITHOUT REMOVAL OF MATERIAL

BACKGROUND OF THE INVENTION

This invention concerns the machining of sheets, or of plates (comparable to sheets in the context of this invention), with a view to modifying the geometry of the faces of said sheets.

In metallurgy rough sheets are usually obtained by rolling. A rolling operation results in a difference in rate of advance of the sheet between upstream and downstream in the rolling operation, which is manifested by an increase in length of the sheet after rolling. Fundamentally, in an operation as described above, the dimensions of the sheet are changed, while keeping a rectangular profile (section perpendicular to the direction of advance). The product obtained has generally parallel faces.

Starting with a standard sheet, it is difficult to obtain profiles with nonparallel faces by rolling. If, for example, the respective axes of the rollers are not parallel, the volume of material treated per unit of width (dimension parallel to the axis of the rollers) is no longer constant. As a result, the rate of advance tends to be greater in the places rolled to lesser thickness. That produces very sizable internal stresses in the rolled sheet and, therefore, very great difficulty in obtaining a rolled product without curvature.

SUMMARY OF THE INVENTION

The objective of this invention is to modify the geometry of the faces of a rough sheet in order to obtain sheets whose faces are not parallel. A particular case consists in obtaining nonparallel, plane faces. By convention, the term "sloped" sheets hereafter refers to sheets whose faces form inclined planes in relation to each other, angles which range from very small to larger angles. According to one particular aspect of this invention, a so-called "sloped" blank is made, from which it is then possible, by any technique, to cut an object to the contour predefined as a function of the final application sought.

The invention proposes a process of machining by deformation a sheet and modifying the thickness between the opposite faces of said sheet, comprising:

flattening the sheet by pressing on one of its faces a working tool having a bearing which has a long longitudinal dimension which extends across the sheet and a thickness of a small dimension, said sheet being supported on its other face by a part having a bearing support surface at least appreciably equivalent and placed opposite said bearing, the large dimension of said bearing being greater than the width of the sheet to be machined, compression being stopped when the clearance between said bearing and-said support surface reaches a predetermined value;

separating said bearing from the face of the sheet;

moving said sheet transversely in relation to the direction of said bearing by a step of predetermined value, repeating the foregoing sequence while varying the predetermined value of clearance from one step to the following step until said sheet has been imparted a section of predetermined thickness depending on the location of the section considered.

Two variant embodiments are explained below. The invention can be applied whenever an end product or a semifinished product is a sheet whose section is trapezoidal, that is, having sloped faces. It is possible to cite, by way of nonlimitative example, the manufacture of knife blades or the manufacture of a certain type of tire tread mold, the basic concept of which is described in U.S. Pat. No. 5,492,669.

The invention will be understood by reference to the following specification, describing by means of the enclosed figures and in nonlimitative fashion two examples of the invention.

DESCRIPTION OF PREFERRED EMBODIMENTS

Figure 1:
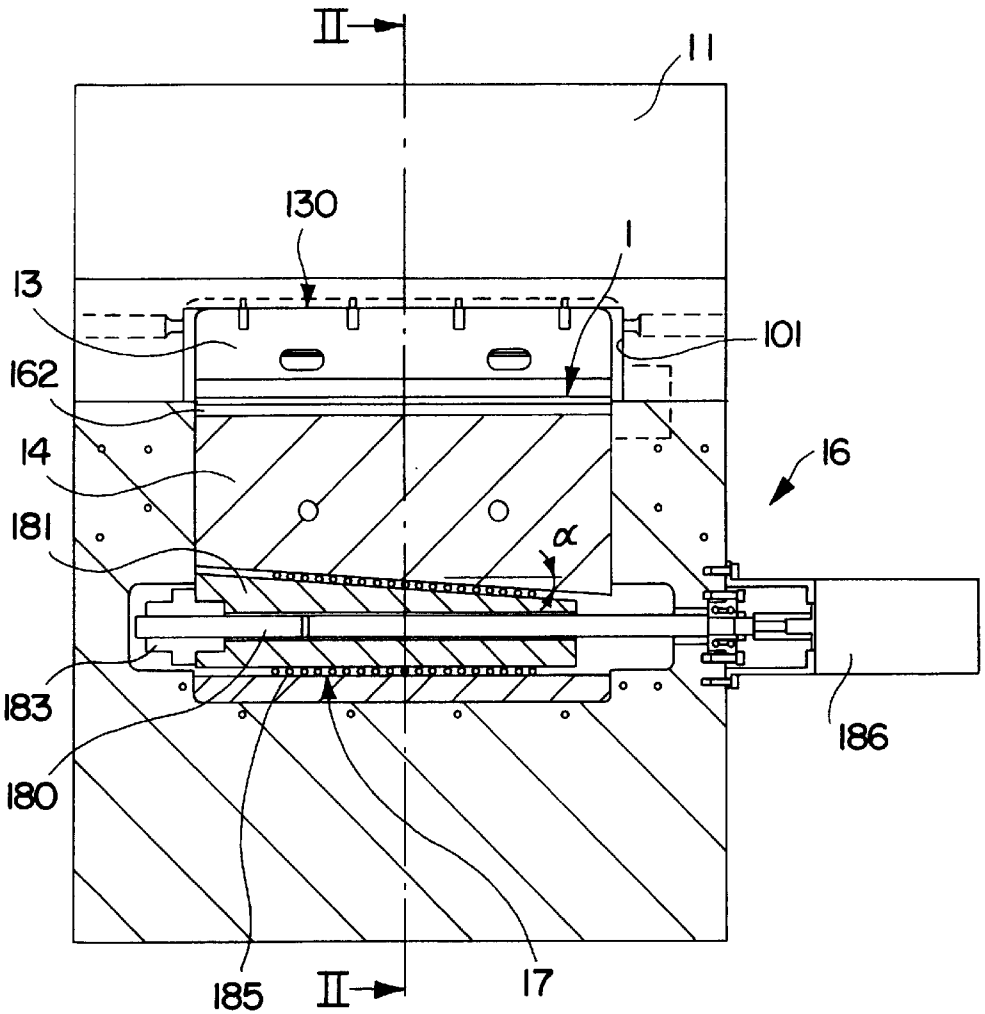
FIG. 1 is a section along I—I of FIG. 2, showing a first variant of a device according to the invention.

The machining device represented on FIGS. 1 to 4 embodies a frame 11 supporting a press 16 containing a plate 162 movable in relation to the frame 11 and a counterplate 161 fixed in relation to the frame 11. The plate 162 extends longitudinally across the press, and it has a bearing defined by a larger longitudinal dimension and a smaller dimension. The plate and counterplate 162 and 161 are mounted opposite each other, leaving between them a predetermined and strictly controlled opening receiving the sheet 2 to be machined. The device contains means for advancing the sheet in relation to the plate and counterplate. In the first variant, the sheet is advanced by a clamp 15 that grasps the sheet 2. The device further contains means for moving said clamp 15 (and therefore the sheet 2) through the space between the plate and counterplate 162 and 161 in successive steps. In its movement away from the plate and counterplate, the clamp will not be too distant from a plane perpendicular to the plane of the opening 1, passing through said opening.

According to one aspect of the invention, the sheet 2 located under a bearing 165 of width W (see FIG. 3) is compressed, each compression being staggered from the previous one, preferably with overlapping of the part subject to compression. Said bearing is, for instance, flat. More generally, if there is a difference between the desired shape and the obtained shape one can correct experimentally the shape of the bearing in order to achieve the desired result for the sheet. The sheet will generally carry the marks of the successive stages by spaced traces of length P of said step (see FIG. 3), P being smaller than W (W being the small dimension of the bearing 165). Successive compressions of the sheet 2 are carried out by acting perpendicular to the plane of the sheet 2. It is a question of reclosing the press 16 on the sheet 2 somewhat more on each step (or somewhat less according to the direction chosen to vary the thickness), by slightly advancing said sheet 2 on each step (arrow F in FIG. 3 recalling the direction of movement of the sheet between two steps).

Figure 2:
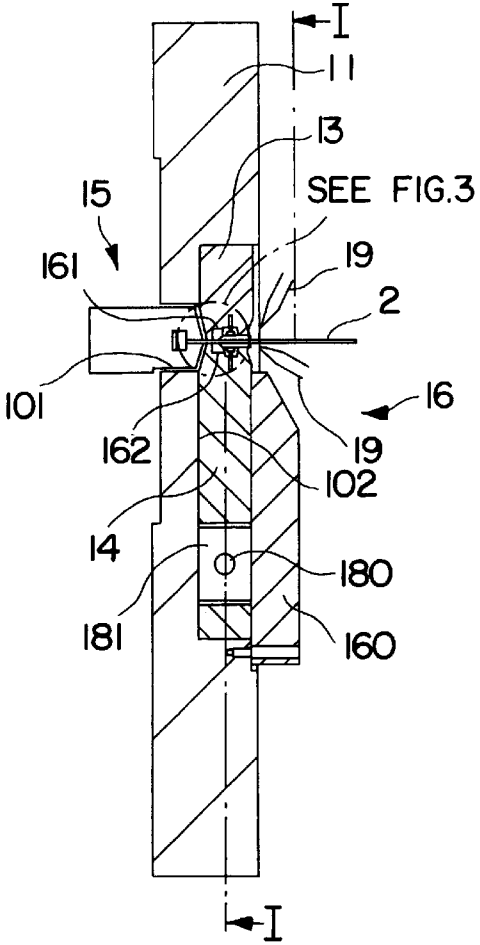
FIG. 2 is a section along II—II of FIG. 1, showing, in particular, a control of movement.
Figure 4:
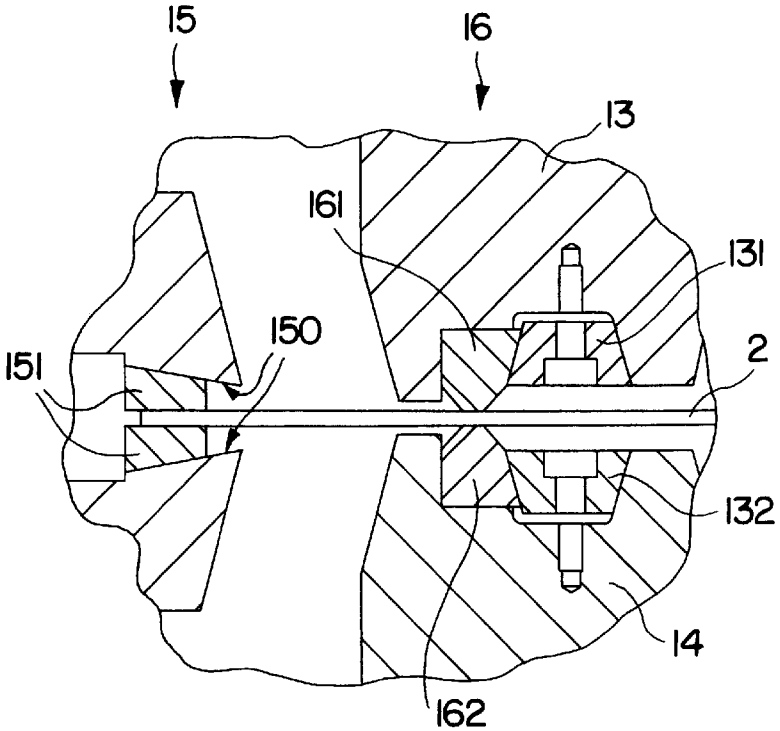
FIG. 4 is a view of the device comparable to that of FIG. 3, showing the sheet in a subsequent machining phase.
Figure 3:
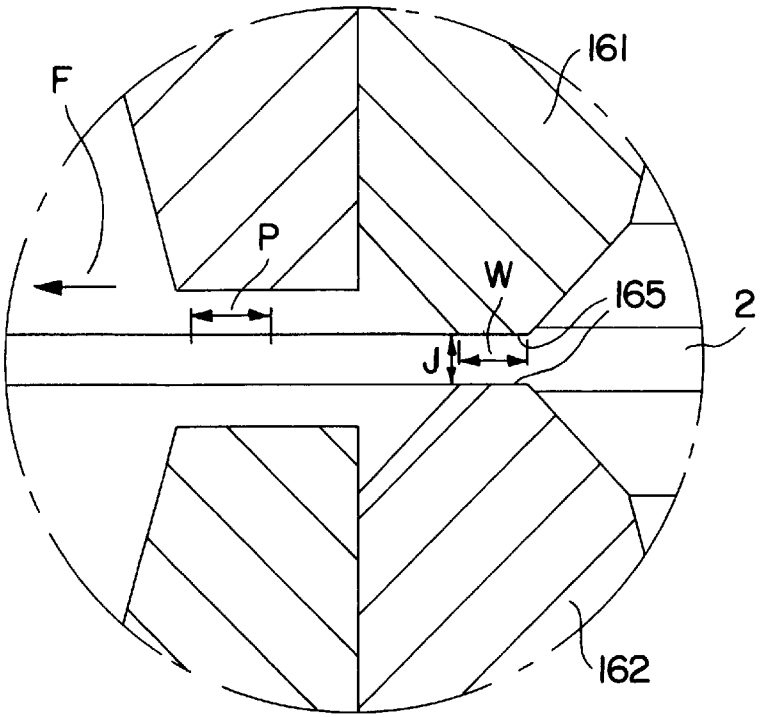
FIG. 3 is an enlargement of the part delimited by circle III in FIG. 2.
Figure 6:
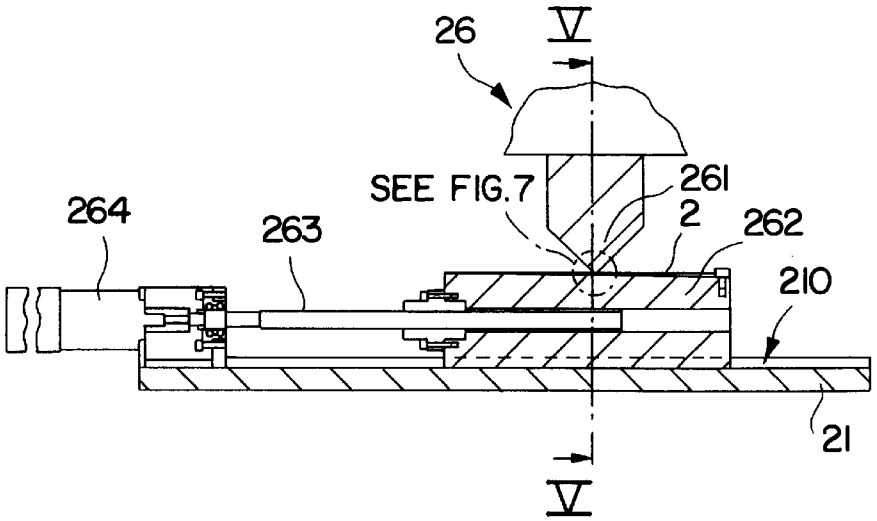
FIG. 6 is a section along VI—VI in FIG. 5, showing, in particular, a control of movement.

The frame 11 has a window 101 open in the center, extended on one side by a clearance 102, receiving the press 16 (see FIG. 2). The counterplate 161 is mounted on a stationary plate holder 13 and plate 162 is mounted on a moving plate holder 14 by means of trapezoidal keys 131 and 132, respectively (see, in particular, FIG. 4). The back 130 of the stationary plate holder 13 is a circular-base cylinder, that is, forming an arc of very great radius when seen in the plane of FIG. 1, in order to be able to adjust the parallelism of the counterplate 161 with the plate 162 by transversely displacing the stationary plate holder 13 in relation to the frame 11.

A wedge 181 is inserted between the moving plate holder 14 and a reference surface 17 on the frame 11, with interposition of needle bearing paths 185. That wedge 181 is mounted on a nut 183, which in turn is mounted on a screw 180. The translation of the screw 180 along its axis is blocked by a suitable arrangement. The translation of the moving plate holder 14 is carried out while it still remains parallel to itself, and the stresses that the moving plate holder 14 exerts in the direction parallel to the axis of the screw 180 are taken up by the frame 11. The moving plate holder 14 and the set of components cooperating with it are kept in place against the frame 11 by a plate 160.

The wedge 181 forms an angle $\alpha$ whose value is chosen to develop on the sheet a stress sufficient to deform it, while insuring that the length of displacement of the wedge is sufficient to control with great precision the relative movement of the plate and counterplate. The screw 180 is driven by a motor 186. The rotation of the screw 180 in one direction makes it possible to move the wedge 181 in one direction (for example, from left to right in FIG. 1); the rotation of the shaft 180 in the other direction makes it possible to move the wedge 181 in the other direction. Taking into account the direction of mounting of the wedge 181, a displacement of the wedge 181 from left to right in FIG. 1 increases the space between the moving plate holder 14 and the reference surface 17 and therefore reduces the distance between the moving plate holder 14 and the stationary plate holder 13 and, in turn, reduces the distance between the plates 161 and 162. The looping of stresses involved passes through the frame 11, dimensioned accordingly. Return springs (not shown) guarantee that the stationary plate holder 13 and moving plate holder 14 are separated from each other when the wedge 181 is moved from right to left in FIG. 1.

In that variant the plate 162 and counterplate 161 are similar and present a symmetrical profile in relation to their large dimension. An appropriate surface treatment makes it possible to endow said bearing 165 with a suitable hardness. For example, tungsten carbide plates having undergone a titanium nitride and molybdenum disulfide base treatment present a suitable resistance and sliding surface (coefficient of friction), combined with lubrication.

Hoses 19 make it possible to project a lubricant, a machine oil, for example, to coat the faces of the sheet just before the opening. For example, a strong chlorine additive oil can be used.

A clamp 15, with self-tightening jaw, is placed parallel to jaw 16. This clamp contains trapezoidal tightening blocks 151 inserted between the object to be gripped (sheet 2) and support surfaces 150 inclined to converge beside the jaw 16. The clamp 15 makes it possible to grip the sheet 2 firmly at one of its ends. The clamp must, of course, be capable of closing to grasp the sheet 2 properly and of opening to release the sheet 2. The necessary structural details will be easily designed by the person of skill in the art and do not appear on the drawing in order not to overload it needlessly. A traction gear (not represented) makes it possible to move the clamp 15 from the jaw 16 (or bring them nearer in order to make the sheet move back between two passes), clamp and jaw remaining constantly parallel, the clamp moving in a plane perpendicular to the plane in which the movement of the plate and counterplate of the jaw 16 is developed. As a variant, a hydraulic tightening clamp can be used.

The device further contains means for stopping the displacement of the moving plate 162 to the counterplate 161, so as to leave between the plate and counterplate a play of predetermined value depending on the step considered and means for controlling the stepped displacement of the sheet and displacement of the moving plate 162 to the counterplate 161 in successive and alternate sequences, each of which varies said predetermined value of clearance from one step to the following step. In this first variant, that is obtained by a judicious control of the motor 186 and of the means of displacement of the clamp 15. In the example of use described, as it is a question of obtaining a sloped blank with flat faces, the variation of the value of spacing or clearance between plate and counterplate is constant for a linear variation of the value of the step. The sequences are as follows: relative adjustment of the plate and counterplate 162 and 161 to a first value of clearance J, relative spacing of the plate and counterplate 161 and 162, displacement of the clamp 15 to the left (FIGS. 2 and 4) of a step P, and relative adjustment of the plate and counterplate to a second value of the clearance J slightly less than the first one, and so on.

According to the present invention, the predetermined value of the clearance can vary from one step to the next following any law.

Figure 5:
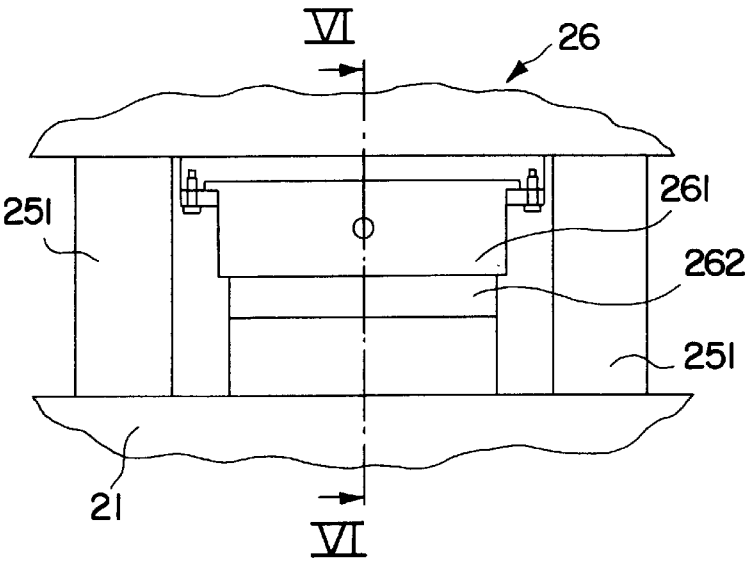
FIG. 5 is a section along V—V in FIG. 6, showing a second variant of the device.
Figure 8:
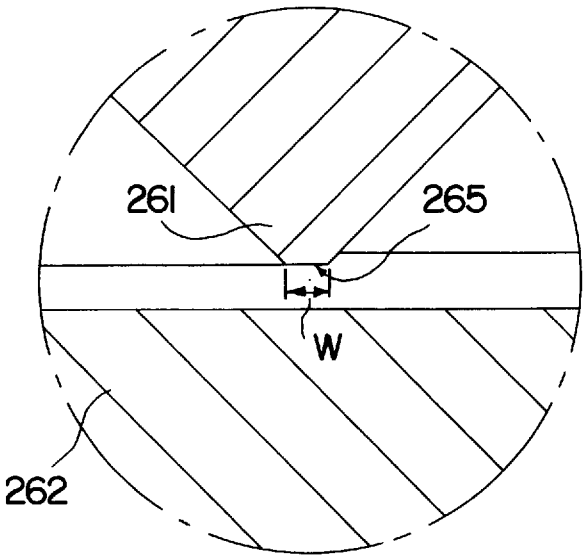
FIG. 8 is an enlargement of the part delimited by circle VIII in FIG. 7.
Figure 7:
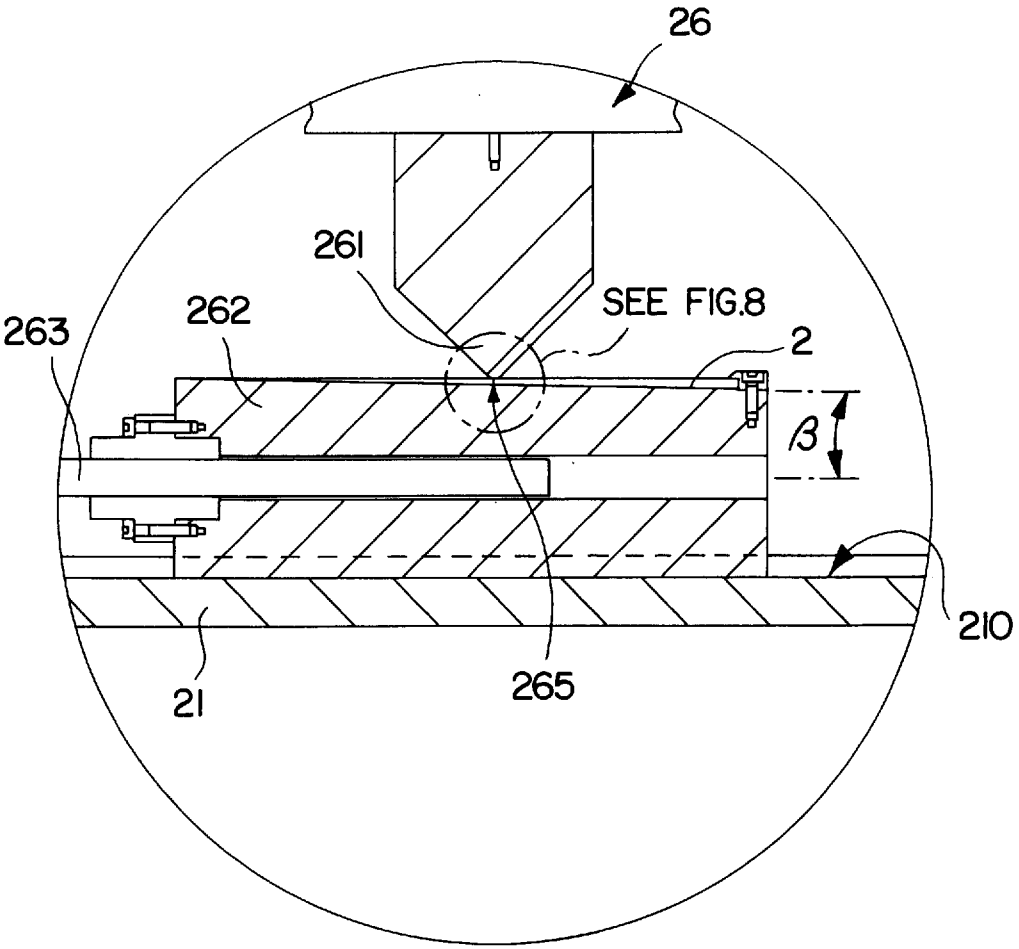
FIG. 7 is a more detailed view of the right part of FIG. 6.

A second variant is described with reference to FIGS. 5 to 8. A plate 261 is shown mounted on the moving plate of the press 26. The counterplate is an anvil 262 which supports the sheet 2 to be machined. Lateral stops 251 limit the descent of the moving plate toward the anvil 262. Said means for controlling the stepped displacement of the sheet containing means for displacing the anvil laterally in relation to the large dimension of the plate: the anvil 262 can slide on the frame 21 of the press in a direction roughly perpendicular to the plane described by the plate 261 in motion. The bearing 265 of the plate 261, coming in contact with the sheet 2, is of very narrow width (FIGS. 6 and 7) and of length corresponding to the width of the sheet to be machined (FIG. 5). The anvil 262 is driven by a motor 264 acting on a screw 263. The anvil forms or supports thereon a surface which forms an angle $\beta$, said angle $\beta$, being identical to the slope angle it is intended to impart to the sheet 2. The value of the angle $\beta$ is exaggerated on the drawings, in order to make this characteristic of the invention better evident.

To machine the sheet, the anvil 262 is transversely displaced in relation to the plate 261 (from right to left in FIGS. 6 to 8) on each step, when the plate 261 is raised. One starts from the end of the sheet to which it is intended to give the minimum thickness (left side in FIGS. 6 to 8). The sheet is compressed between the plate 261 and the anvil 262 by lowering the plate 261 until the press encounters the stops 251. The plate 261 is progressively raised, the sheet having advanced each time by a step P slightly less than the width W of the bearing surface 265 of the plate 261, and then compression is repeated. In that variant, the trace of the successive steps on the surface of the sheet is more indistinct than in the previous variant, because the descent of the plate 161 is stopped each time on the same side, the slope coming from the inclination β of the receiving surface of the sheet 2 on the anvil 262 in relation to the guiding surface 210 of the anvil 262 on the frame 21. On each step, the extent of the compression varies; for example, it progressively diminishes when the anvil moves from right to left in FIGS. 6, 7 and 8.

It has been observed that, as with many other machining techniques, the best results are obtained if, in the course of a pass, the rate of deformation of the sheet does not exceed certain limits. That depends on the nature of the material. It is also necessary to take into account the slope angle and the length machined. In fact, taking into account the fact that the total volume of materials is maintained, the parameter to be taken into account is the quantity of material displaced by machining. The more there is, the greater the number of passes required. From one pass to the next, compression is continued. Thus, for example, for a ductile stainless steel, if a slope angle reaching a magnitude of 0.1° is desired, for a machined length in the order of 10 centimeters, it is preferable to work in at least two successive passes. Thus, on each pass, a relationship aiming at different thicknesses is used.

The invention makes it possible to machine without supply of heat. The invention also makes it possible to machine everything by having constant rates of deformation along the section worked. The resulting advantage is the absence or at least very slight impact of parasite deformations and, therefore, little or no buckling of the sheet after machining.

The proposed machining process easily fits into a more complex installation fabricating blanks for a particular application. For example, one starts with a continuous metal strip, the width and thickness of which are chosen according to the width and maximum thickness of the sloped blank to be fabricated. The strip, packaged, for example, in coil form, is cut into pieces which feed a machining device, as described. If several passes are required, then the anvil contains a means of adjustment of the angle β and the anvil goes back between two passes, or else two devices are used one after the other in which the angle β of the anvils is different. In the course of successive passes, the faces of the sheet remain flat, the relative inclination increasing.

Machining by deformation, as proposed, makes possible a great saving of material, compared to machining by removal of material. The type of material depends on the application sought, the process being suitable for all sufficiently ductile materials. A particularly important application of the invention lies in machining steel sheets between 0.5 millimeter and 3 millimeters thick.

As mentioned above, the invention is advantageously applicable to the manufacture of a type of tire tread mold. Referring to the specification of a tire mold given in U.S. Pat. No. 5,492,669, it is observed that said mold is formed by circumferential stacking of a large number of elements, the section of which, seen in a plane perpendicular to the axis of the mold, is preferably trapezoidal. The invention proposes a process which makes it possible to obtain a blank suitable for cutting said elements. Said elements are then cut to the desired profile so that, on the narrower side, a part of the section will be in a molding zone of a corresponding section of the tread, and on the outside of said molding zone the section complementing the aforementioned part will cooperate with devices controlling the mold opening and closing movements.

The steel thus machined is a stainless steel, by reason of use of the blanks in a tire mold. With a continuous strip, blanks are mass-produced by applying the process described above and then production is coordinated by progressively cutting one or more of the elements in each blank, according to the profile desired, and progressively stacking said elements to form said mold.

Figure 9:
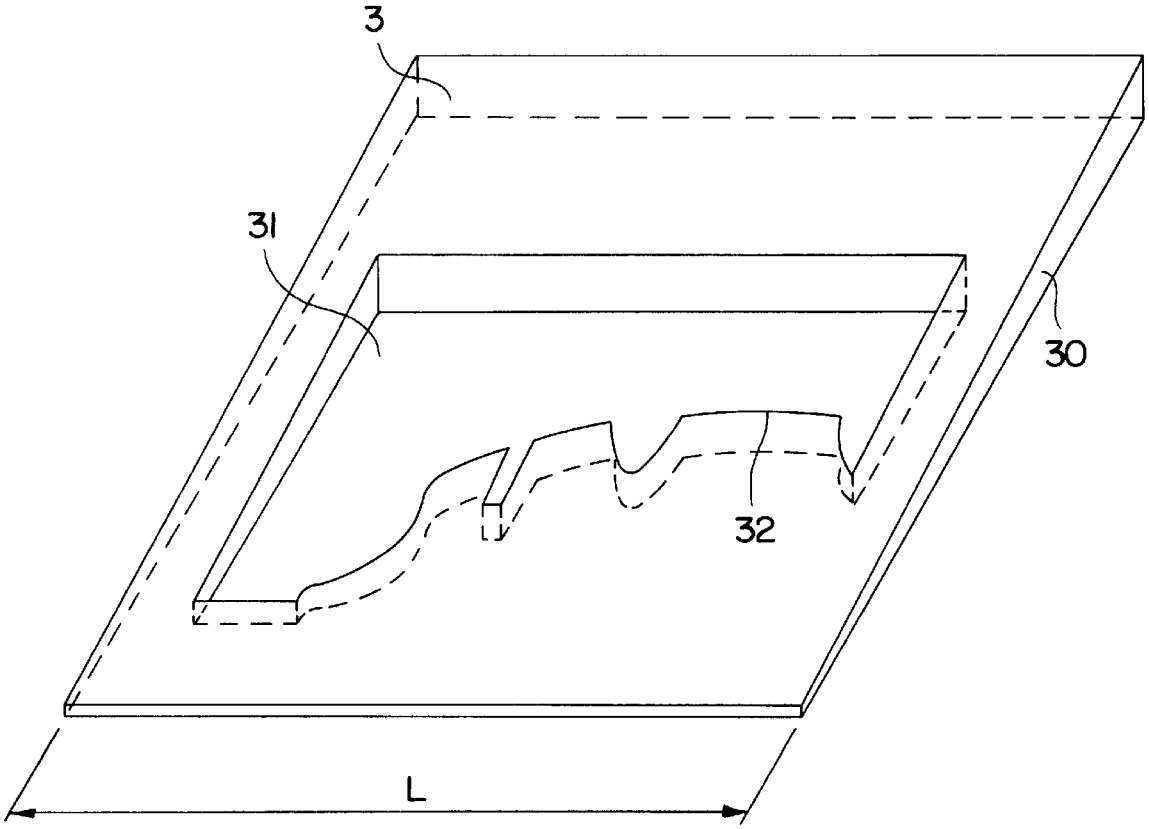
FIG. 9 illustrates the application to manufacture of a tire mold.

More precisely, the dimensions of the blank 3 are determined from the mathematical definition of the tread surface, as the tire designer has conceived it, and from choice of the number of elements to be contained in the crown ensuring the molding of said tread. FIG. 9 shows that it is a trapezoid, seen in section perpendicular to the axis of rotation of the tire (see face 30), the width L of the blank being sufficient to cut here a single element such as 31. An initial metal strip is chosen according to the width L and maximum thickness of the trapezoid. In that blank each of the elements 31 is then cut, preferably using cutting means dependent on the profile 32 of the tread to be molded. Cutting of the profile 32 will, of course, typically be different for each of the elements 31, according to the sculptured pattern of the tread to be molded. The invention lends itself perfectly well to computer-assisted manufacture. From the computer files containing the definition of the sculpture, a preform cutting tool can be controlled, such as, for example, a laser cutting tool. The invention therefore makes it possible to produce molds of the type described in U.S. Pat. No. 5,492,669 according to a very direct method.

We claim:

1. A process of machining a sheet having opposite faces and a thickness between opposite faces and for modifying the thickness of the sheet across a width of the sheet and at successive sections along a length of the sheet, comprising:

compressing the sheet by pressing on one of its faces a longitudinal tool bearing having a large longitudinal dimension and a small dimension, said sheet being supported on its other face by a part having a bearing support surface opposite said tool bearing, the large dimension of said tool bearing being greater than the width of the section of the sheet to be compressed, compression being stopped when a clearance remaining between said tool bearing and said support surface reaches a predetermined value;

separating said tool bearing from the face of the sheet;

moving said sheet transversely in relation to the longitudinal dimension of said bearing by a step of predetermined value, repeating the foregoing compressing, separating and moving steps while varying said predetermined value of clearance from one compressing step to the following compressing step until said sheet has been imparted a predetermined thickness at each section.

2. A process according to claim 1, in that the variation of the value of clearance is constant for a linear variation of value of the step.

3. A process according to claim 1, in that the value of said moving step is less than the small dimension of said tool bearing.

4. A process according to claim 1, in which the machining entails several successive passes and in which the compression is continued on each pass.

5. A process for manufacturing a tire tread mold, said mold being formed by circumferential stacking of a large number of elements, each having a cross-section which, in a plane perpendicular to the axis of the mold, is trapezoidal, comprising fabricating blanks by applying the process according to claim 1 and cutting one or more elements in each blank to the desired profile so that, on the narrower side, a part of the section will be in a molding zone of a corresponding section of the tread, and so that outside said molding zone the section will cooperate with devices controlling the mold opening and closing movements.

6. A device for machining of a sheet having opposite faces and a thickness and controlling the thickness across a width of the sheet and at successive sections along a length of the sheet, comprising:

a press embodying a movable longitudinal plate having a bearing with a large dimension and a small dimension;

a counterplate and means for relatively moving the plate to the counterplate;

means for locking the sheet on the counterplate;

means for moving the sheet in successive steps, laterally relative to the large dimension of the plate bearing;

means for limiting relative movement between the plate bearing and the counterplate, so as to leave between the plate bearing and the counterplate a clearance predetermined for each step;

means for controlling the movement of the sheet in successive steps and the relative movement of the plate bearing to the counterplate in successive sequences, each of which varies said predetermined clearance from one step to the following step.

7. A device according to claim 6, in which the plate bearing, in section perpendicular to its large dimension, presents a symmetrical profile.

8. A device according to claim 6, including a clamp for grasping the sheet, said means for controlling the stepped movement of the sheet including means for moving said clamp relative to said plate and counterplate.

9. A device according to claim 6, in which the counterplate is an anvil and said means for controlling the stepped movement of the sheet includes means for moving the anvil laterally relative to the large dimension of the plate.

10. A device according to claim 6, including means for dispensing a lubricating fluid opposite the plate bearing.

11. A process for producing a sheet in which a thickness between opposite surfaces across a width of the sheet progressively changes along a length of the sheet comprising feeding the sheet lengthwise and in predetermined increments between a sheet pressing tool and a support surface, the sheet pressing tool engaging one surface across said width of the sheet along a length smaller than the predetermined increment of feed, imparting relative movement to the sheet pressing tool and the support surface to bring the sheet pressing tool against one surface of the sheet and the support surface against the opposite surface of the sheet between steps of feeding the sheet in predetermined increments, a clearance between the sheet pressing tool and the support surface determining the thickness of the sheet along the length pressed by the sheet pressing tool, and progressively changing the clearance along the length of the sheet.

12. A device for producing a sheet in which a thickness between opposite surfaces across a width of the sheet progressively changes along a length of the sheet comprising a sheet pressing tool, a support surface for the sheet, means for feeding the sheet lengthwise and in predetermined increments between the sheet pressing tool and the support surface, the sheet pressing tool engaging one surface across said width of the sheet along a length smaller than the predetermined increment of feed, means imparting relative movement to the sheet pressing tool and the support surface to bring the sheet pressing tool against one surface of the sheet and the support surface against the opposite surface of the sheet between steps of feeding the sheet in predetermined increments, a clearance between the sheet pressing tool and the support surface determining the thickness of the sheet along the length pressed by the sheet pressing tool, and means for progressively changing the clearance along the length of the sheet.

* * * * *